US005614328A

United States Patent [19]

Suzuki et al.

[11] Patent Number: 5,614,328

[45] Date of Patent: Mar. 25, 1997

[54] REFLOW-PLATED MEMBER AND A MANUFACTURING METHOD THEREFOR

[75] Inventors: Satoshi Suzuki; Kazuya Takahashi; Teruo Kawada; Yuuji Suzuki; Morimasa Tanimoto, all of Tokyo, Japan

[73] Assignee: The Furukawa Electric Co. Ltd., Tokyo, Japan

[21] Appl. No.: 534,330

[22] Filed: Sep. 27, 1995

[30] Foreign Application Priority Data

Jan. 19, 1995 [JP] Japan ..... 7-006370

[51] Int. Cl.[6] ..... B32B 15/20; C25D 5/50

[52] U.S. Cl. ..... 428/647; 428/935; 428/939; 148/518; 205/226

[58] Field of Search ..... 428/647, 644, 428/607, 645, 935, 939; 18/518, 536; 205/226; 439/886

[56] References Cited

U.S. PATENT DOCUMENTS

| | | | |
|---|---|---|---|
| 4,427,469 | 1/1984 | Swartz et al. | 156/50 |
| 4,622,205 | 11/1986 | Fouts et al. | 420/566 |
| 5,178,965 | 1/1993 | Tench et al. | 428/647 |
| 5,310,574 | 5/1994 | Holtmann | 427/58 |

FOREIGN PATENT DOCUMENTS

| | | | |
|---|---|---|---|
| 2730625 | 1/1979 | Germany | 428/647 |
| 55-151710 | 11/1980 | Japan | 428/647 |

*Primary Examiner*—John Zimmerman

*Attorney, Agent, or Firm*—Frishauf, Holtz, Goodman, Langer & Chick, P.C.

[57] ABSTRACT

Provided is a method for manufacturing a reflow-plated member, which comprises a process for forming a plated layer of Sn or Sn alloy on the surface of a base material, at least the surface of which is formed of Cu or Cu alloy, by electroplating, and a process for running the base material at a traveling speed equivalent to 80% to 90% of the lowest traveling speed that said plated layer does not melt when the base material is continuously run for reflowing in a heating furnace at a predetermined temperature. The obtained reflow-plated member is excellent in any of properties including solderability, heat resistance, bendability, wear resistance, and corrosion resistance.

9 Claims, 1 Drawing Sheet

REFLOW-PLATED MEMBER AND A MANUFACTURING METHOD THEREFOR

BACKGROUND OF THE INVENTION

1. Field of the Invention

The present invention relates to a reflow-plated member and a manufacturing method therefor, and more specifically, to a method for manufacturing a reflow-plated member which is satisfactory or excellent in wettability by solder, bendability, and heat resistance.

2. Prior Art

Plated members may be obtained by coating the surface of a base material made of Cu or Cu alloy with Sn or Sn alloy. They are high-performance conductors which efficiently combine the good electrical conductivity and mechanical strength of Cu or Cu alloy and the corrosion resistance and solderability of a coating layer of Sn or Sn alloy, and are used in a wide variety of applications, including various electrical and electronic appliance parts, such as terminals, connectors, lead wires, etc., and wire cables.

Conventionally, the connectors are fabricated by plating the surface of a strip of Cu alloy with Sn or Sn alloy and punching pieces in a predetermined shape from the plated strip. In this case, however, scraps are inevitably produced in the punching process. Recently, therefore, scrap-free pin connectors (pin-grid arrays) have been developed and started to use, as their pin material, a square wire (base material) of Cu alloy plated with solder (Sn—Pb alloy).

Melt plating and bright electroplating are prevailing methods of preparing the material of this kind.

The melt plating is a method in which a base material of Cu or Cu alloy is continuously run in molten Sn or Sn alloy so that its surface is coated with a layer of Sn or Sn alloy.

Although this method ensures relatively low manufacturing cost, it involves a problem that the resulting layer is highly irregular in thickness, entailing a large variation in thickness. Moreover, a thick layer of a Cu—Sn intermetallic compound is liable to be formed on the interface between the base material (Cu or Cu alloy) and the layer, resulting in the following awkward problems.

If the Cu—Sn intermetallic compound layer, a rigid layer itself, is thick, the resulting plated member sometimes may be fractured when it is bent in machining, for example. The Cu—Sn intermetallic compound, moreover, is a chemically stable substance itself. If this layer is too thick, therefore, the compound cannot easily react to solder when the plated member is soldered, so that the solderability of the layer is lowered.

On the other hand, the bright electroplating has frequently been used as a method which enables formation a thin layer of uniform thickness. According to this method, the surface of the layer is smoothed and brightened by loading a plating bath of Sn or Sn alloy with additives, such as benzylideneacetone, cinnamaldehyde, or other brightener and glue, gelatin, β-naphthol, or other smoothing agent.

In the case of the bright electroplating, however, the additives are occluded at the boundaries between deposited crystal grains which constitute the formed plated layer, so that the binding power between the crystal grains is lessened. As a result, a Cu component of the base material and the like freely diffuse at the grain boundaries, and the aforesaid Cu—Sn intermetallic compound layer is formed thick in the plated layer, so that the bendability and solderability of the plated layer are liable to be lowered. The additives make the crystal grains more minute, thereby enlarging distortion at the grain boundaries. This accelerates diffusion of the Cu component and the like, which entails the aforesaid problems.

If the deposited crystal grains become more minute, discoloration advances starting from the grain boundaries, and is accelerated by change in properties of the additives which are occluded at the grain boundaries or adsorbed by the plated layer surface.

If the binding power between the crystal grains is lessened by the occlusion of the additives, moreover, the wear resistance of the plated layer is lowered. If the plated member is touched by a working tool or the like to be subjected to external force when it is worked, for example, the plated layer is liable to pulverize and separate from the base material. In some cases, furthermore, the additives may grow whiskers, as well as the crystal grains, so that the resulting plated member cannot be a reliable electrical or electronic appliance part.

In order to solve the problems of the melt plating and bright electroplating described above, a reflowing method has been developed and is widely-used now.

In this reflowing method, a plated layer is first formed on the surface of a base material by electroplating, using a plating bath of Sn or Sn alloy which is loaded with only a smoothing agent without containing any of the aforesaid brighteners. Then, the resulting plated member is continuously run in an furnace which is adjusted to a predetermined temperature, whereby the plated layer is melted and brightened.

According to the reflowing method described above, the additive (smoothing agent) occluded at the grain boundaries during the plating process is thermally decomposed and removed in a reflowing process in the next stage, so that the binding power between the crystal grains is enhanced. In the reflowing process, moreover, stress strain at the grain boundaries is eased. Thus, plated members (reflow-plated members) manufactured in the reflowing process surpass ones which are manufactured by the melt plating or bright electroplating in bendability, solderability, wear resistance, etc.

Even according to this reflowing method, however, a relatively thick Cu—Sn intermetallic compound layer may be formed on the interface between the base material and the plated layer, depending on the reflowing conditions, so that the bendability or solderability may possibly be lowered. After the reflowing process, moreover, the crystal grains in the reflowed-plated layer may become so coarse that the wettability of the layer surface by solder is worsened. After the plated layer is reflowed, furthermore, it cannot enjoy a satisfactory wear resistance, and may pulverize, though only slightly, when it is rubbed.

With the recent progress of miniaturization of electrical and electronic appliance parts, the reflow-plated members have come to require further improvement in various properties, such as formability, springiness, and electrical conductivity, and also a satisfactory heat resistance such that stable functions can be fulfilled even under severe temperature conditions.

However, the molten state of the plated layer (Sn or Sn alloy) formed on the surface of the base material (Cu or Cu alloy) varies depending on the reflowing conditions.

If the running speed of the plated member in the reflowing process is too low, for example, the plated layer melts so that its fluidity increases. If the running speed is too high, on the other hand, melting of the plated layer cannot advance, so that the reflowed layer cannot be brightened.

The thickness of the reflowed-plated layer becomes irregular, that is, one portion of the reflowed-plated layer becomes thicker than another, if the running speed of the base material during the reflowing process is so low that the fluidity of the molten plated layer is increased, if the molten state of the plated layer lasts for a long period of time, or if the base material oscillates violently during the reflowing process. After prolonged actual use of the reflow-plated members at high temperature, the Cu component of the base material or Cu—Sn intermetallic compound layer may diffuse to the surface of the thinner portion of the reflowed-plated layer, thereby changing its color. These reflow-plated members are poor in heat resistance.

In the case where the target reflow-plated member is a solder-plated square wire whose base material is the aforementioned square wire, in particular, the molten layer is caused by surface tension to flow from the corner portions of the square wire to the flat portions thereof during the reflowing process. As a result, the reflowed-plated layer at the corner portions becomes so thin that the discoloration is liable to occur. Inevitably, therefore, the heat resistance of the solder-plated square wire would be worsened.

OBJECTS AND SUMMARY OF THE INVENTION

An object of the present invention is to provide a method for manufacturing a reflow-plated member having various satisfactory or excellent properties, including solderability, bendability, wear resistance, and heat resistance, in which the deviation in the thickness of the reflowed-plated layer is inhibited from becoming large by appropriately controlling the reflowing conditions in manufacturing the reflow-plated member.

Another object of the invention is to provide a reflowed-solder-plated square wire manufactured by the aforesaid method.

In order to achieve the above objects, according to the present invention, there is provided a method for manufacturing a reflow-plated member, which comprises a process for forming a plated layer of Sn or Sn alloy on the surface of a base material, at least the surface of which is formed of Cu or Cu alloy, by electroplating, and a process for running the base material at a traveling speed equivalent to 80% to 90% of the lowest traveling speed that the plated layer does not melt when the base material is continuously run for reflowing in a heating furnace at a predetermined temperature.

According to the present invention, moreover, there is provided a reflow-plated member which comprises a base material at least the surface of which is formed of Cu or Cu alloy, and a reflowed-plated layer of Sn or Sn alloy covering the surface of the base material, the inner layer portion of the reflowed-plated layer reserving a crystal grain structure formed by electroplating.

Furthermore, there is provided a reflowed-solder-plated square wire which comprises a square wire formed of Cu or Cu alloy, and a reflowed-solder-plated layer covering the surface of the square wire, the reflowed-solder-plated layer being composed of an aggregate of Sn crystal grains and Pb phases precipitated at the boundaries between the crystal grains.

DETAILED DESCRIPTION OF THE INVENTION

Figure 1:
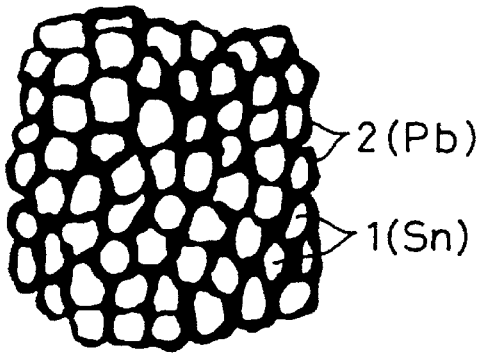
FIG. 1 is a schematic view showing a crystal grain structure of a reflowed-solder-plated layer manufactured by a method according to the present invention.

In a method according to the present invention, Sn or Sn alloy is first plated on the surface of a base material.

The base material used may be Cu, as a simple substance for the whole structure, or Cu alloy, such as brass, phosphor bronze, beryllium-copper, Cu—Ni—Si alloy, or nickel silver. Alternatively, the base material may be a composite material which is formed of a steel or aluminum core material coated with Cu or the aforesaid Cu alloy. The base material is not specially limited in shape, and may be a wire, strip, bar, pipe, or material of any other desired shape.

In the case where the target member is a reflowed-solder-plated square wire, it is advisable to use as the base material the aforesaid Cu alloy which is excellent in corrosion resistance and mechanical strength.

The Sn alloy with which the surface of the base material is coated may be, for example, Sn—Pb (solder), Sn—Ni, Sn—Co, Sn—Zn, Sn—In, Sn—Ag, Sn—Cu, Sn—Sb, or Sn—Pd alloy.

Among these Sn alloys, the Sn—Pb alloy may be a conventional solder which contains 5% to 60% of Pb by weight.

A plated layer of Sn or Sn alloy with a uniform thickness is formed on the surface of the base material by electroplating. If the plated layer is too thin, a Cu component of the base material, Cu—Sn intermetallic compound, etc. diffuse to the surface of the layer, change color, and tend to lower solderability after prolonged use of the manufactured member at high temperature, even though the plated layer is reflowed in the manner mentioned later. Preferably, therefore, the thickness of the plated layer should be adjusted to 2 μm or more.

Subsequently, reflowing of the plated layer on the base material surface is carried out by causing the base material continuously to travel in a heating furnace which is controlled at a predetermined temperature.

If the traveling speed of the base material is too low, the plated layer is fully melted when it gets out of the furnace. As the traveling speed is increased gradually, the level of the molten state of the plated layer is lowered. After a certain high speed is attained, the plated layer comes to get out of the furnace without having been melted.

In this process, a smoothing agent and other additives, which are occluded at the grain boundaries and used in electroplating, are thermally decomposed and removed.

The method according to the present invention is characterized in that the traveling speed (V) of the base material is adjusted to 80% to 96% of the lowest traveling speed ($V_0$) for the plated layer to come to an unmolten state.

If the traveling speed V is lower than 80% of the value $V_0$, the reflowed-plated layer comes to the following state. As the plated layer, which is composed of fine crystal grains deposited by electroplating, gets out of the furnace and is cooled after it is fully melted, the molten-plated layer solidifies. Crystal grains are grown again in this process of solidification. These grown crystal grains are coarser than the ones deposited by electroplating.

However, coarse crystal grains are lower in wettability by solder than fine ones. Having the coarse crystal grains, therefore, the layer reflowed at the aforesaid traveling speed is poor in solderability.

When the plated layer is reflowed at the aforesaid traveling speed, the fluidity of the molten layer is augmented, so that the degree of deviation in thickness of the reflowed-plated layer increases. Thin portions of the reflowed-plated layer discolor, so that the heat resistance of the reflowed-plated layer, as well as its solderability, is lowered.

If the traveling speed V is higher than 96% of the value $V_0$, on the other hand, the greater part of the plated layer is unmolten, so that the resulting reflowed-plated layer cannot enjoy satisfactory brightness. Besides, the resulting layer is so low in wear resistance that it is liable to pulverize and falls off the surface of the base material.

In consideration of these circumstances, according to the present invention, the traveling speed V of the base material during the reflowing process is controlled so as to be within a range, $0.8 \times V_0 \leqq V \leqq 0.96 \times V_0$.

If a traveling speed within this range is selected, all the fine crystal grains deposited on the base material surface by electroplating cannot melt. Those crystal grains which are situated in the outer layer portion of the plated layer melt and change into coarser grains, while those crystal grains which are situated in the inner layer portion of the plated layer, that is, the region nearer to the base material surface, never melt and remain fine.

When soldering is carried out, therefore, fine crystal grains in the inner layer portion of the reflowed-plated layer effectively fulfill their functions, so that the entire reflowed-plated layer can maintain good solderability.

The ratio in thickness between the inner and outer layer portions in the thickness direction of the reflowed-plated layer is not specially limited. If the percentage of the outer layer portion is too high, however, the solderability of the reflowed-plated layer lowers considerably. Normally, therefore, it is advisable to set the traveling speed of the base material so that the thickness of the outer layer portion is 1.5 μm or less in the case where the overall thickness of the plated layer is 2 μm or more.

FIG. 1 shows a crystal grain structure of the reflowed-plated layer obtained when the traveling speed V of the base material is set within the range, $0.8 \times V_0 \leqq V \leqq 0.96 \times V_0$, in the case where the target member is a reflowed-solder-plated square wire.

More specifically, the reflowed-plated layer is an aggregate of Sn crystal grains 1, including Pb phases 2 precipitated at the boundaries between the crystal grains 1 so as to cover them.

Figure 2:
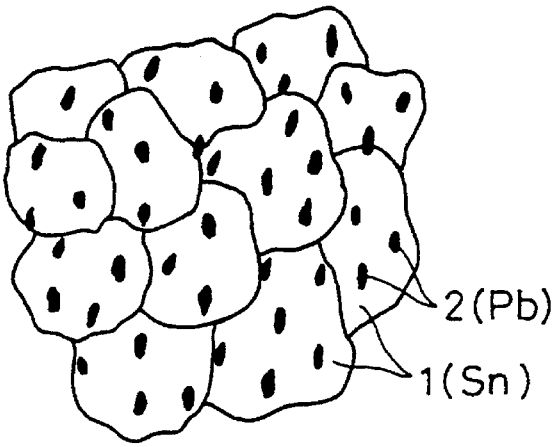
FIG. 2 PRIOR ART
FIG. 2 is a schematic view showing a crystalgrain structure of a reflowed-solder-plated layer manufactured by a conventional method.

In the case where the traveling speed V is higher or lower than the aforesaid level, in contrast with this, the reflowed-plated layer has a structure such that spherical Pb phases 2 are precipitated at random in the Sn crystal grains 1, as shown in FIG. 2.

In the case of the reflowed-plated layer structure shown in FIG. 1, the Cu component of the base material (square wire) is restrained from diffusing to the surface of the reflowed-plated layer through the grain boundaries as diffusion channels, since the Pb phases, which do not react to Cu, are precipitated at the grain boundaries. Thus, the formation of the Cu-Sn intermetallic compound on the interface between the base material and the reflowed-plated layer is inhibited, and the resulting intermetallic compound layer is much thinner than in the case of the reflowed-plated layer shown in FIG. 2, and the intermetallic compound cannot diffuse to the reflowed-plated layer surface.

As a result, the resulting reflowed-solder-plated square wire is improved in bendability, and its high-temperature solderability is prevented from lowering.

Figure 3:
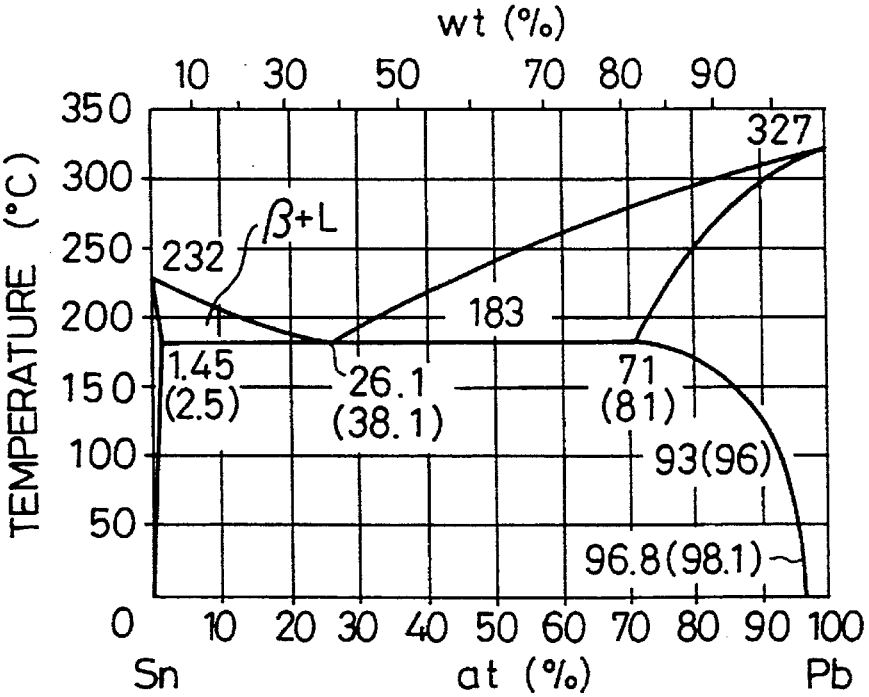
FIG. 3 is an Sn—Pb state diagram.

Preferably, in this case, the solder for electroplating has a composition which covers a region β+L in the Sn—Pb state diagram of FIG. 3, the reflowing temperature is adjusted to a level which also covers the region β+L, and the aforementioned traveling speed is used, for the following reasons. In the process of reflowing, a temperature gradient is generated between the outer and inner layer portions of the plated layer. In the process of cooling, moreover, β-phase components start to solidify in the inner layer portion (at relatively low temperature), Pb diffuses to the outer layer portion (at relatively high temperature), and the reflowed-plated layer is subjected to an Sn—Pb concentration gradient in the thickness direction. More specifically, the Pb concentration of the outer layer portion of the reflowed-plated layer is rich, ranging from 32% to 38% by weight.

Accordingly, the diffusive action of the Cu component diffused from the base material (square wire) is restrained by the Pb phases precipitated at the boundaries between the Sn crystal grains in the course, and diffusion to the reflowed-plated layer surface is securely inhibited by the agency of the Pb phases which exist richly in the outer layer portion. Also, lowering of solderability under high-temperature is prevented more effectively, and the bendability is further improved.

Having the reflowed-plated layer structure shown in FIG. 1, the reflowed-solder-plated square wire according to the present invention enjoys high binding power between Sn crystal grains. Also because the aforesaid Cu—Sn intermetallic compound layer is very thin, therefore, the wire is not liable to fracture when it is bent in machining, and its wear resistance is high. Thus, the reflowed-plated layer is not likely to be pulverized and separated by external force, if any.

The bendability of the wire can be improved considerably by adjusting the thickness of the Cu—Sn intermetallic compound layer to. 0.45 μm or less.

Preferably, in this case, the average crystal grain size after the reflowing process is adjusted to 2 μm or more. With use of this grain size, the overall area of the grain boundaries which function as the diffusion channels for the Cu component is reduced, and the chance of formation of the Cu—Sn intermetallic compound is lessened.

Moreover, the deviation in thickness of the reflowed-plated layer can be restrained by controlling the traveling speed for the reflowing process within the aforesaid range during the manufacture of the reflowed-solder-plated square wire. Thus, discoloration at the corner portions of the square wire cannot be easily caused by the reduction of the reflowed-plated layer in thickness at the corner portions.

According to the reflowing process of the present invention, the degree of deviation in thickness of the reflowed-plated layer can be restricted to 1.5 or less.

The degree of deviation in thickness used herein is a value which is obtained by dividing a maximum value of the thickness of a reflowed-solder-plated layer, measured by means of a fluorescent X-ray film thickness indicator with a collimator diameter of 0.1 mm, by an average value obtained by measuring the thickness of the reflowed-solder-plated layer by the constant-current anodic dissolution method. Thus, the smaller this value, the lower the degree of deviation in thickness is.

EXAMPLES 1 TO 10 AND COMPARATIVE EXAMPLES 1 TO 4

Reflow-tinned brass strips were manufactured in the following manner.

First, a brass strip (0.3 mm thick) supplied from an uncoiler was dipped in an electrolytic degreasing tank, first rinsing tank, acid washing tank, and second rinsing tank in succession, to be subjected to pretreatments for plating.

Then, the brass strip was dipped in a copper-plating tank to form a 1.0-μm thick Cu substrate plated layer on its surface, and was then rinsed in a third rinsing tank.

The brass strip was dipped for electroplating in a plating tank containing an organic-acid electrolyte loaded with a smoothing agent from Ishihara Yakuhin Co., Ltd., whereupon plated layers with the compositions and thicknesses shown in Table 1-1 and 1- 2 were formed.

Subsequently, the treated strip was dipped in a fourth rinsing tank to be rinsed therein, dried by means of a first hot-air dryer, and then continuously run in a heating furnace at the traveling speeds shown in Table 1-1 and 1-2. Thereafter, the strip was quenched in a water tank and dried by means of a second hot-air dryer. The resulting reflow-plated brass strip was coiled by means of a coiler.

The reflow-plated brass strips thus obtained were examined for the following properties.

Crystal grain size: Each reflow-plated brass strip was dipped in a hydrochloric-acid electrolyte so that each reflowed-plated layer was subjected to anodic dissolution with a current density of 2 A/dm$^2$. Crystal structures in depths of 0.1 μm, 1.0 μm, and 1.7 μm from the surface of the layer were extracted, and the size and number of crystal grains in a 1,000-power view field were measured by using a scanning electron microscope, and an average value was obtained.

Solderability: The zero-cross time (in seconds) was determined by meniscography. One end of each reflow-plated brass strip was dipped to a depth of 2 mm in an eutectic solder of 230° C. with 25% -rosin/methanol as a flux at a speed of 2 mm/sec for immersion time of 10 seconds. The solderability was evaluated on the basis of the time (in seconds) required before buoyancy becomes zero. The shorter this time, the higher the solderability would be.

The solderability measurement was conducted immediately after the reflowing process and after an atmospheric heating test.

Observation of surface discoloration: The surface of each reflowed-plated layer was checked for discoloration immediately after the reflowing process and after 24 hours and 48 hours of heating in the atmosphere at 155° C.

Table 1-1 and 1-2 shows the results of the above measurements en bloc.

TABLE 1-1

| | | | Example No. | | | | | |
|---|---|---|---|---|---|---|---|---|
| | | | 1 | 2 | 3 | 4 | 5 | 6 |
| Plated layer | Composition | | Sn | Sn | Sn | Sn | Sn | Sn-10 wt % Pb |
| | Thickness (μm) | | 2 | 3 | 5 | 2 | 2 | 2 |
| Reflowing process | Furnace temperature (°C.) | | 530 | 530 | 530 | 530 | 530 | 510 |
| | Traveling speed for unmolten plated layer (A:m/min) | | 50 | 50 | 50 | 50 | 50 | 50 |
| | Traveling speed (B:m/min) | | 45 | 45 | 45 | 40 | 47 | 45 |
| | (B × 100)/A (%) | | 90 | 90 | 90 | 80 | 94 | 90 |
| Reflowed-plated layer structure and crystal grain size after reflowing (μm) | 0.1 μm deep below surface | Structure | Solidified solution structure | Solidified solution structure | Solidified solution structure | Solidified solution structure | Solidified solution structure | Solidified solution structure |
| | | Grain size (μm) | 3 | 6 | 8 | 12 | 3 | 6 |
| | 1.0 μm deep below surface | Structure | Solidified solution structure | Solidified solution structure | Solidified solution structure | Solidified solution structure | Plating structure | Solidified solution structure |
| | | Grain size (μm) | 2 | 3 | 3 | 8 | 1 | 3 |
| | 1.7 μm deep below surface | Structure | Plating structure | Plating structure | Plating structure | Plating structure | Plating structure | Plating structure |
| | | Grain size (μm) | 1≧ | 1≧ | 1≧ | 1≧ | 1≧ | 1≧ |
| State immediately after reflowing | Appearance | | smooth bright surface | smooth bright surface | smooth bright surface | smooth bright surface | smooth bright surface | smooth bright surface |
| | Solderability (seconds) | | 0.9 | 1.0 | 0.9 | 1.1 | 0.8 | 0.7 |
| State after heating in atmosphere | After 24 hours of heating | Appearance | No color change | No color change | No color change | No color change | No color change | No color change |
| | | Solderability (seconds) | 1.0 | 1.0 | 0.9 | 1.1 | 0.9 | 0.8 |
| | After 48 hours of heating | Appearance | Grayish | No color change | No color change | Grayish | Grayish | Grayish |
| | | Solderability (seconds) | 1.6 | 1.0 | 0.9 | 2.2 | 2.4 | 1.9 |

| | | Example No. | | | |
|---|---|---|---|---|---|
| | | 7 | 8 | 9 | 10 |
| Plated layer | Composition | Sn-40 wt % Pb | Sn-10 wt % Zn | Sn-5 wt % Ni | Sn |
| | Thickness (μm) | 2 | 2 | 2 | 1.5 |
| Reflowing process | Furnace temperature (°C.) | 470 | 500 | 800 | 530 |
| | Traveling speed for unmolten plated layer (A:m/min) | 50 | 50 | 50 | 50 |
| | Traveling speed (B:m/min) | 45 | 45 | 45 | 48 |
| | (B × 100)/A (%) | 90 | 90 | 90 | 96 |

TABLE 1-1-continued

| | | | | | | |
|---|---|---|---|---|---|---|
| Reflowed-plated layer structure and crystal grain size after reflowing (μm) | 0.1 μm deep below surface | Structure | Solidified solution structure | Solidified solution structure | Solidified solution structure | Solidified solution structure |
| | | Grain size (μm) | 6 | 4 | 2 | 2 |
| | 1.0 μm deep below surface | Structure | Solidified solution structure | Plating structure | Plating structure | Solidified solution structure |
| | | Grain size (μm) | 3 | 1 | 1 | 1≧ |
| | 1.7 μm deep below surface | Structure | Plating structure | Plating structure | Plating structure | Solidified solution structure |
| | | Grain size (μm) | 1≧ | 1≧ | — | — |
| State immediately after reflowing | Appearance | | smooth bright surface | smooth bright surface | smooth bright surface | smooth bright surface |
| | Solderability (seconds) | | 0.6 | 0.9 | 1.0 | 1.0 |
| State after heating in atmosphere | After 24 hours of heating | Appearance | No color change | No color change | No color change | Grayish |
| | | Solderability (seconds) | 0.6 | 0.9 | 1.1 | 2.8 |
| | After 48 hours of heating | Appearance | Grayish | Grayish | Grayish | Gray |
| | | Solderability (seconds) | 1.7 | 2.2 | 2.3 | >10 |

TABLE 1-2

| | | | Comparative Example No. | | | |
|---|---|---|---|---|---|---|
| | | | 1 | 2 | 3 | 4 |
| Plated layer | Composition | | Sn | Sn | Sn | Sn |
| | Thickness (μm) | | 1.5 | 3 | 5 | 2 |
| Reflowing process | Furnace temperature (°C.) | | 530 | 530 | 530 | 530 |
| | Traveling speed for unmolten plated layer (A:m/min) | | 50 | 50 | 50 | 50 |
| | Traveling speed (B:m/min) | | 35 | 35 | 35 | 50 |
| | (B × 100)/A (%) | | 70 | 70 | 70 | 100 |
| Reflowed-plated layer structure and crystal grain size after reflowing (μm) | 0.1 μm deep below surface | Structure | Solidified solution | Solidified solution structure | Solidified solution structure | Plating structure structure |
| | | Grain size (μm) | 15 | 15 | 15 | 1≧ |
| | 1.0 μm deep below surface | Structure | Solidified solution structure | Solidified solution structure | Solidified solution structure | Plating structure |
| | | Grain size (μm) | 15 | 15 | 15 | 1≧ |
| | 1.7 μm deep below surface | Structure | Solidified solution structure | Solidified solution structure | Solidified solution structure | Plating structure |
| | | Grain size (μm) | — | 15 | 15 | 1≧ |
| State immediately after reflowing | Appearance | | smooth bright surface | Highly fluid | Highly fluid | Luterless |
| | Solderability (seconds) | | 3.5 | 3.6 | 3.5 | 0.7 |
| State after heating in atmosphere | After 24 hours of heating | Appearance | Grayish | Grayish | Grayish | Gray |
| | | Solderability (seconds) | 4.0 | 4.2 | 4.1 | >10 |
| | After 48 hours of heating | Appearance | Gray | Gray | Gray | — |
| | | Solderability (seconds) | >10 | >10 | >10 | — |

AS seen from Table 1-1 and 1-2, the reflow-plated members of Examples 1 to 9, among others manufactured with use of the traveling speed for the reflowing process according to the present invention, had a smooth bright surface, and their zero-cross time indicative of solderability was as short as 1.1 seconds or less. Although the thickness of each plated layer was 2 μm or more, no flow of the plated layer was recognized during the reflowing process. Further, the grain size of the crystal grains in the outer layer portion (from surface to depth of 0.1 μm) was 2 μm or more, and no dusting occurred at all. Even after 48 hours of atmospheric heating, discoloration was slight and practically negligible, the solderability and heat resistance were satisfactory. In Examples 2 and 3 for cases of relatively thick plated layers, in particular, no discoloration was observed at all, and the solderability was good enough after 48 hours of atmospheric heating. In Example 9, the melting point of the plated layer, an alloy of Sn and 5% Ni by weight, was as high as about 650° C. The composition of the outer layer portion was changed by thermal diffusion of Pb in a solder bath so that the melting point of the reflowed-plated layer was lowered. Thus, the reflowed-plated layer was quickly melted and removed, and good solderability was obtained between the outer and inner layer portions. In Example 10, the appearance and solderability after the reflowing process were satisfactory. Since the plated layer was as thin as 1.5 μm, however, discoloration was observed after 48 hours of atmospheric heating, and the solderability was low.

In addition, the members of the individual examples were examined for corrosion resistance, wear resistance, whiskering resistance, etc., and proved excellent in these properties.

With respect to reflow-plated brass strips of Comparative Examples 1 to 4, in contrast with this, the traveling speed for the reflowing process was low, so that the grain size of the crystal grains in the inner layer portion of each reflowed-plated layer was large, and the solderability was low. For heat resistance, the plated layer of Comparative Example 1 was so thin that it discolored after 48 hours of atmospheric heating. The plated layers of Comparative Examples 2 and 3 were thick and flowed during the reflowing process, so that their thin portions discolored after 48 hours of atmospheric heating. In the case of Comparative Example 4, the traveling speed for the reflowing process was too high for the plated layer to melt, so that the resulting reflowed-plated layer surface was lusterless, and dusting was caused. Since the smoothing agent was left, moreover, the binding power at the grain boundaries was low, so that the base material, Cu, diffused there to form a Cu—Sn intermetallic compound in the reflowed-plated layer. As a result, the reflowed-plated layer discolored to gray after 24 hours of atmospheric heating, and this discoloration worsened the solderability.

EXAMPLES 11 TO 14 AND COMPARATIVE EXAMPLES 5 TO 8

Reflow-solder-plated brass square wires were manufactured in the following manner.

First, a brass square wire (0.5 mm square) supplied from the uncoiler was dipped in the electrolytic degreasing tank, first rinsing tank, acid washing tank, and second rinsing tank in succession, to be subjected to pretreatments for plating.

Then, the brass square wire was dipped in the copper-plating tank to form a 1.0-μm thick Cu substrate plated layer on its surface, and was then rinsed in the third rinsing tank.

The brass square wire was dipped for electroplating in the plating tank containing a borofluoric-acid electrolyte loaded with the smoothing agent from Ishihara Yakuhin Co., Ltd., whereupon a plated layer, made of an alloy of Sn and 10% Pb by weight and having a thickness of 2.0 μm, was formed.

Subsequently, the brass square wire was dipped in the fourth rinsing tank to be rinsed therein, dried by means of the first hot-air dryer, and then continuously run in the heating furnace at the traveling speeds shown in Table 2-1 and 2-2. Thereafter, the square wire was quenched in the water tank and dried by means of the second hot-air dryer. The resulting reflow-plated brass square wire was coiled by means of the coiler.

In Comparative Example 8, conventional bright solder-electroplating was conducted without the reflowing process.

The reflowed-solder-plated brass square wires thus obtained were examined for the following properties.

Corrosion resistance: (1) After each sample was left to stand in the atmosphere at 105° C. temperature and 100% relative humidity for 24 hours, its surface was checked for discoloration. At the same time, meniscography was conducted in the aforementioned conditions, and the zero-cross time was determined. (2) After each sample was left to stand in the atmosphere at 155° C. temperature for 24 hours, its surface was checked for discoloration. At the same time, meniscography was conducted in the aforementioned conditions, and the zero-cross time was determined.

Bendability: Each sample was self-coiled and its surface was checked for cracking by means of a stereoscopic microscope (1,000-power). Samples without any cracking were regarded as wires with satisfactory bendability.

Wear resistance: Each sample was reciprocated for 100 strokes covering a sliding distance of 50 mm and under 50-g load by using a Bowder-type abrasion tester and a reflow-tinned strip, having its distal end pressed to 5 R, as a sliding probe, and was checked for dusting.

Degree of deviation in thickness of reflowed-plated layer (κ): The maximum thickness of each reflowed-plated layer was measured by means of the fluorescent X-ray film thickness indicator with the collimator diameter of 0.1 mm. On the other hand, each sample was dipped in a hydrochloric-acid electrolyte, a constant current with the density of 2 A/dm$^2$ was applied for anodic dissolution, and the average thickness of the reflowed-plated layer was measured by the dissolution time. Then, the maximum thickness was divided by the average thickness.

Thickness of Cu—Sn intermetallic compound layer: Each sample was dipped in the hydrochloric-acid electrolyte by the constant-current anodic dissolution method, the constant current with the density of 2 A/dm$^2$ was applied, and the thickness of the Cu—Sn intermetallic compound layer was obtained from the dissolution potential and dissolution time.

Reflowed-plated layer structure: The structure of each reflowed-plated layer was observed by using the 1,000-power scanning electron microscope.

Table 2-1 and 2-2 shows the results of the above measurements.

TABLE 2-1

| | | | Example No. | | | |
|---|---|---|---|---|---|---|
| | | | 11 | 12 | 13 | 14 |
| Reflowing process | Furnace temperature (°C.) | | 480 | 480 | 480 | 450 |
| | Traveling speed for unmolten plated layer (A:m/min) | | 40 | 40 | 40 | 30 |
| | Traveling speed (B:m/min) | | 32 | 36 | 37 | 27 |
| | (B × 100)/A (%) | | 80 | 90 | 92.5 | 90 |
| Corrosion resistance | Water-vapor resistance test | Appearance | No change | No change | No change | No change |
| | | Solderability (seconds) | 1.3 | 1.2 | 1.1 | 1.3 |
| | Heating test | Appearance | No change | No change | No change | No change |
| | | Solderability (seconds) | 1.2 | 1.2 | 1.1 | 1.3 |

TABLE 2-1-continued

| | | | | | | |
|---|---|---|---|---|---|---|
| Bendability (degree of surface cracking) | | | No cracking | No cracking | No cracking | No cracking |
| Wear resistance (degree of dusting) | | | No dusting | No dusting | No dusting | No dusting |
| Degree of deviation in thickness (κ) | | | 1.4 | 1.2 | 1.1 | 1.3 |
| Thickness of Cu—Sn intermetallic compound layer (μm) | | | 0.38 | 0.35 | 0.30 | 0.38 |
| Reflowed-plated layer structure | Average grain size of Sn crystal grains (μm) | | 11 | 8 | 3 | 9 |
| | State of deposition of Pb phase | | Deposited at grain boundaries | Deposited at grain boundaries | Deposited at grain boundaries | Deposited at grain boundaries |
| | | | Example No. | | | |
| | | | 15 | 16 | 17 | 18 |
| Reflowing process | Furnace temperature (°C.) | | 420 | 510 | 510 | 450 |
| | Traveling speed for unmolten plated layer (A:m/min) | | 20 | 50 | 50 | 30 |
| | Traveling speed (B:m/min) | | 18 | 45 | 48 | 24 |
| | (B × 100)/A (%) | | 90 | 90 | 96 | 80 |
| Corrosion resistance | Water-vapor resistance test | Appearance | No change | No change | No change | No change |
| | | Solderability (seconds) | 1.3 | 1.1 | 1.1 | 1.3 |
| | Heating test | Appearance | No change | No change | No change | Slightly discolored at corners |
| | | Solderability (seconds) | 1.2 | 1.1 | 2.8 | 2.2 |
| Bendability (degree of surface cracking) | | | No cracking | No cracking | No cracking | Slight cracking |
| Wear resistance (degree of dusting) | | | No dusting | No dusting | Scanty dusting | Scanty dusting |
| Degree of deviation in thickness (κ) | | | 1.4 | 1.1 | 1.0 | 1.6 |
| Thickness of Cu—Sn intermetallic compound layer (μm) | | | 0.40 | 0.32 | 0.28 | 0.46 |
| Reflowed-plated layer structure | Average grain size of Sn crystal grains (μm) | | 12 | 6 | 1.6 | 13 |
| | State of deposition of Pb phase | | Deposited at grain boundaries | Deposited at grain boundaries | Deposited at grain boundaries | Deposited at grain boundaries |

TABLE 2-2

| | | | Comparative Example No. | | | |
|---|---|---|---|---|---|---|
| | | | 5 | 6 | 7 | 8 |
| Reflowing process | Furnace temperature (°C.) | | 480 | 480 | 480 | Bright electro-plating |
| | Traveling speed for unmolten plated layer (A:m/min) | | 40 | 40 | 40 | |
| | Traveling speed (B:m/min) | | 28 | 24 | 40 | |
| | (B × 100)/A (%) | | 70 | 60 | 100 | |
| Corrosion resistance | Water-vapor resistance test | Appearance | No change | No change | Yellowed | Yellowed |
| | | Solderability (seconds) | 1.4 | 1.5 | 1.1 | 1.2 |
| | Hearing test | Appearance | Discolored at corners | Discolored at corners | Extensively discolored | Extensively discolored |
| | | Solderability (seconds) | 4.3 | 7.6 | >10 | >10 |
| Bendability (degree of surface cracking) | | | Minor cracking | Substantial cracking | Slight cracking | Substantial cracking |
| Wear resistance (degree of dusting) | | | Some dusting | Some dusting | Intense dusting | Intense dusting |
| Degree of deviation in thickness (κ) | | | 1.8 | 2.0 | 1.0 | 1.0 |
| Thickness of Cu–Sn intermetallic compound layer (μm) | | | 0.50 | 0.60 | 0.28 | 0.35 |
| Reflowed-plated layer structure | Average grain size of Sn crystal grains (μm) | | 15 | 13 | 1≧ | 1≧ |
| | State of deposition of Pb phase | | Dispersed in Sn crystal grains | Dispersed in Sn crystal grains | Unknown | Dispersed in Sn crystal grains |

As seen from Table 2-1 and 2-2, all the examples produced satisfactory results for any of the properties which include the corrosion resistance, solderability, bendability., and wear resistance. In Example 17, among these examples, the size of the Sn crystal grains is 1.6 μm, which is a relatively small value, so that the grain boundaries are increased, and therefore, the solderability and wear resistance are somewhat poorer than in any of other examples. In Example 18, the degree of deviation in thickness is 1.6, which is a relatively large value, so that some of Cu from the brass square wire diffuses to the surface of the corner portions at which the reflowed-solder-plated layer is thinned, thereby causing slight discoloration. Moreover, the Cu—Sn intermetallic compound layer is relatively thick, so that the bendability and wear resistance are a little lower than in-other cases.

In Comparative Examples 5 to 8, in contrast with this, one or some of the properties including the corrosion resistance, solderability, bendability, and wear resistance are lowered. For the appearance after the water-vapor resistance test, Comparative Examples 7 and 8 displayed yellowing, which is attributable to small Sn crystal grains. In the case of Comparative Example 8, in particular, intense yellowing occurred, since additives were occluded at the grain boundaries. For the solderability after the water-vapor resistance test, zero-cross times for Comparative Examples 5 to 8 were 1 second or thereabouts, presenting no marked differences. Even in the cases of Comparative Examples 7 and 8 which are subject to discoloration, Sn oxide formed on the surface of each sample was easily dissolved in the molten solder in a short time, so that no reduction of the solderability was recognized.

For the appearance of the surface after atmospheric heating, Comparative Examples 5 and 6 were subject to gray discoloration at corner portions which were caused as follows. The solder at the corner portions flowed to the flat portions and was reduced in thickness, so that the degree of deviation in thickness was increased. Thus, the solder at the thinned solder layer portions reacted to Cu diffused from the square wire by heating, thereby forming a Cu—Sn intermetallic compound layer. The intermetallic compound layer was exposed on the reflowed-plated layer surface, so that the corner portions discolored to gray. In Comparative Examples 7 and 8, the Sn crystal grains were fine, and the gaps between the grains were wide, so that Cu from each square wire diffused at high speed. Accordingly, the reflowed-solder-plated layer was converted entire into a Cu—Sn intermetallic compound layer, and its whole surface discolored to gray. In any of Comparative Examples 5 to 7, the Cu—Sn intermetallic compound layer was exposed on the surface of the reflowed-solder-plated layer, so that the zero-cross time, which is indicative of the solderability after atmospheric heating, was extended considerably.

In a self-coiling test for bendability, Comparative Examples 5 to 8 suffered substantial cracking, since the Cu—Sn intermetallic compound layers of Comparative Examples 5 and 6 were too thick, and the solder plated layers of Comparative Examples 7 and 8 were unmolten, and hence, the binding power between their crystal grains were low.

In a wear resistance test, Comparative Examples 5 and 6 produced solder dust. Although the cause of the production of solder dust is unclear, this phenomenon is presumably attributable to the fact that the reflowed-solder-plated layer can be easily shaven during the wear resistance test, since the rigid Cu—Sn intermetallic compound layer is thick enough for the whole reflowed-plated layer to be stiff. Dusting in the cases of Comparative Examples 7 and 8 is attributable to the low binding power between the crystal grains.

What is claimed is:

1. A method for manufacturing a reflow-plated member, comprising:

a process for forming a plated layer of Sn or Sn alloy on the surface of a base material, at least the surface of which is formed of Cu or Cu alloy, by electroplating; and a process for running the base material at a traveling speed equivalent to 80% to 96% of the lowest traveling speed that said plated layer does not melt when said base material is continuously run for reflowing in a heating furnace at a predetermined temperature.

2. The method of claim 1 wherein the process for running the base material is at a travelling speed equivalent to 80% of said lowest travelling speed.

3. A reflow-plated member comprising:

a base material at least the surface of which is formed of Cu or Cu alloy; and a reflowed-plated layer of Sn or Sn alloy covering the surface of said base material, the inner layer portion of said reflowed-plated layer reserving a crystal grain structure formed by electroplating.

4. A reflowed-solder-plated square wire comprising:

a square wire formed of Cu or Cu alloy; and a reflowed-solder-plated layer covering the surface of the square wire, said reflowed-solder-plated layer being composed of an aggregate of Sn crystal grains and Pb phases precipitated at the boundaries between said crystal grains.

5. A reflowed-solder-plated square wire according to claim 4, wherein the grain size of said Sn crystal grains is 2 μm or more.

6. A reflowed-solder-plated square wire according to claim 5, wherein the thickness of a Cu—Sn intermetallic compound layer formed on the interface between said square wire and said reflowed-solder-plated layer is 0.45 μm or less.

7. A reflowed-solder-plated square wire according to claim 6, wherein the degree (κ) of deviation in thickness of said reflowed-solder-plated layer is 1.5 or less, said degree (κ) being a value obtained by dividing a maximum value of the thickness of the reflowed-solder-plated layer, measured by means of a fluorescent X-ray film thickness indicator with a collimator diameter of 0.1 mm, by an average value obtained by measuring the thickness of the reflowed-solder-plated layer by the constant-current anodic dissolution method.

8. A reflowed-solder-plated square wire according to claim 4, wherein the thickness of a Cu—Sn intermetallic compound layer formed on the interface between said square wire and said reflowed-solder-plated layer is 0.45 μm or less.

9. A reflowed-solder-plated square wire according to claim 4, wherein the degree (κ) of deviation in thickness of said reflowed-solder-plated layer is 1.5 or less, said degree (κ) being a value obtained by dividing a maximum value of the thickness of the reflowed-solder-plated layer, measured by means of a fluorescent X-ray film thickness indicator with a collimator diameter of 0.1 mm, by an average value obtained by measuring the thickness of the reflowed-solder-plated layer by the constant-current anodic dissolution method.

* * * * *